US010557248B2

(12) United States Patent
Lin et al.

(10) Patent No.: US 10,557,248 B2
(45) Date of Patent: Feb. 11, 2020

(54) POST-GROUTING METHOD FOR IMMERSED TUBE JOINT BASE

(71) Applicants: CCCC Highway Consultants Co., Ltd., Beijing (CN); China Communication 2nd Navigational Bureau 2nd Engineering Co., Ltd., Chongquing (CN); The Second Harbor Engineering Company, Wuhan (CN)

(72) Inventors: Wei Lin, Beijing (CN); Jibing Gao, Beijing (CN); Heng Liang, Beijing (CN); Kexin Liu, Beijing (CN); Li Wang, Beijing (CN); Changcheng Wei, Beijing (CN); Yu Liu, Beijing (CN); Bin Wu, Beijing (CN); Chao Liu, Beijing (CN); Yuwen Li, Beijing (CN); Qingxi Zeng, Beijing (CN); Wei Feng, Beijing (CN); Kaikai Li, Beijing (CN)

(73) Assignees: CCCC Highway Consultants Co. Ltd., Beijing (CN); China Communication 2nd Navigational Bureau 2nd Engineering Co., Ltd., Chongquing (CN); The Second Harbor Engineering Company, Wuhan (CN)

( * ) Notice: Subject to any disclaimer, the term of this patent is extended or adjusted under 35 U.S.C. 154(b) by 0 days.

(21) Appl. No.: 15/870,590

(22) Filed: Jan. 12, 2018

(65) Prior Publication Data

US 2019/0063031 A1 Feb. 28, 2019

(30) Foreign Application Priority Data

Aug. 31, 2017 (CN) ..... 2017 1 0776350

(51) Int. Cl.
*E02D 27/52* (2006.01)
*E02D 29/073* (2006.01)
*E02B 17/00* (2006.01)

(52) U.S. Cl.
CPC ..... *E02D 27/525* (2013.01); *E02B 17/0008* (2013.01); *E02D 29/073* (2013.01); *E02D 2250/0061* (2013.01)

(58) Field of Classification Search
CPC combination set(s) only.
See application file for complete search history.

(56) References Cited

U.S. PATENT DOCUMENTS 4,081,970 A * 4/1978 Dowse ..... E02D 29/06 405/204
4,191,496 A * 3/1980 Becker ..... E02D 27/32 248/550

(Continued)

*Primary Examiner* — Kyle Armstrong
(74) *Attorney, Agent, or Firm* — Andrew D. Fortney; Central California IP Group, P.C.

(57) ABSTRACT

The present application relates to the field of immersed tube jointing, and more particularly relates to a post-grouting method for an immersed tube joint base. The post-grouting method includes the following steps: before locked back-filling of immersed tubes to be implanted, disposing a grouting tube capable of outputting solidifiable slurry in a furrow below immersed tubes; and after the locked back-filling, grouting the immersed tubes by using the grouting tube. For the purposes of adjusting postures and heights of the immersed tubes in case of abnormal settlement during installation, solving the problems on the stabilities and the service lives of immersed tube joints due to settlement of gravel mattresses or a geologic structure thereunder after installation, and enabling the immersed tubes to achieve a better bearing effect on a load during use, the present application provides the post-grouting method for the immersed tube joint base.

20 Claims, 5 Drawing Sheets

(56) References Cited

U.S. PATENT DOCUMENTS

| | | | | |
|---|---|---|---|---|
| 4,889,448 | A * | 12/1989 | Bell | E02D 29/07 405/135 |
| 2007/0237587 | A1 * | 10/2007 | Mullins | E02D 3/12 405/266 |
| 2007/0248416 | A1 * | 10/2007 | Aristaghes | E02D 29/07 405/137 |

* cited by examiner

POST-GROUTING METHOD FOR IMMERSED TUBE JOINT BASE

This application claims the benefit of Chinese Patent Application No. 2017107763500, filed Aug. 31, 2017, incorporated herein by reference in its entirety.

TECHNICAL FIELD

The present application relates to the field of immersed tube jointing, and more particularly relates to a post-grouting method for an immersed tube joint base.

BACKGROUND ART

Some large-sized bridges having extremely large spans generally include subsea tunnel sections. A subsea tunnel is formed by connecting a plurality of immersed tubes. Besides the several immersed tubes, the subsea tunnel mentioned in the present application also includes a "sandwich immersed tube structure" capable of being simultaneously connected with immersed tubes on two sides at two final immersed tube jointing portions (the "sandwich immersed tube structure" is also called a final joint which is also an immersed tube, namely a section of a relatively special immersed tube, and after this section of immersed tube is connected with the immersed tubes at its two ends, the subsea tunnel is through).

Corresponding gravel mattresses are disposed on a subsea geologic structure of an installation position of the immersed tubes (including the "sandwich immersed tube structure"). A clearance is reserved between adjacent gravel mattresses, thus forming a furrow. In addition, due to a paving process of the gravel mattresses (an S-shaped trend, as shown in FIG. 4), besides the large furrow formed by the clearance between two gravel mattresses below an immersed tube joint, a plurality of small furrows smaller than the large furrows are also disposed at the top of each gravel mattress.

Specifically, in case of no furrows, when the immersed tubes (including the "sandwich immersed tube structure") are descended and placed on the gravel mattresses, pressure generated thereby would press the gravel mattresses, the pressed gravel mattresses below immersed tube joints would upwards move to a water stop band, and if the pressure is extremely high, gravels in the gravel mattresses may possibly break through the water stop band; therefore, a furrow structure is disposed.

However, the furrow structure is defective. In an installation process of the immersed tubes (including the "sandwich immersed tube structure"), under the pressure, the gravel mattresses or a geologic structure thereunder may be possibly settled (for example, one of the reasons is that after locked backfilling, if the gravel mattresses are pressed, part of the gravels may possibly move into the furrows, which leads to thinning of gravel mattresses at other positions, thereby resulting in settlement), and at this time, installation postures and heights of the immersed tubes (including the "sandwich immersed tube structure") do not accord with the standard: the structure itself is tilted or a height deviation (relatively low) occurs relative to an ideal installation position, thus the installation postures and heights need to be readjusted, but the adjustment is relatively difficult, and may affect the progress and the effect of installation; particularly for the final joint, its two ends need to be simultaneously connected with the end portions of two immersed tubes, thus a very high installation requirement is required; if a support at the bottom of the final joint is settled during installation, it is really hard to adjust the installation posture by a conventional adjustment mode (such as hoisting), the efficiency is extremely low, and an adjustment effect is not ideal.

Then, after the immersed tubes (including the "sandwich immersed tube structure") are installed, the gravel mattresses may be possibly settled due to environmental influence in the sea, and at this time, force, which is originally shared by the gravel mattresses, on the immersed tubes (including the "sandwich immersed tube structure") at the settled positions is applied to adjacent immersed tube wall bodies through connection members; and under the condition that adjacent immersed tubes have already borne part of force supporting the immersed tubes (including the "sandwich immersed tube structure"), such force transferring may possibly damage connection positions of the immersed tubes and the adjacent immersed tubes (including connection positions of the "sandwich immersed tube structure" and the adjacent immersed tubes), affect the stabilities and the service lives of joints of the immersed tubes (including the "sandwich immersed tube structure"), and then cause a potential safety hazard.

In addition, after the immersed tubes (including the "sandwich immersed tube structure") are installed, the gravel mattresses do not apply prestress or apply relatively low prestress to the support of the immersed tubes (including the "sandwich immersed tube structure"), and the immersed tubes (including the "sandwich immersed tube structure") has a poor bearing effect on a load (vehicles and part of external forces) during use.

SUMMARY OF THE INVENTION

In view of the problems in the prior art, for the purposes of adjusting postures and heights of immersed tubes during their installation, solving the problems on the stabilities and the service lives of immersed tube joints due to settlement of gravel mattresses or a geologic structure thereunder after installation, and enabling the immersed tubes to achieve a better bearing effect on a load during use, the present application provides a post-grouting method for an immersed tube joint base.

In order to achieve the above-mentioned purposes, the technical scheme adopted by the present application is as follows:

A post-grouting method for an immersed tube joint base is provided, including:

before locked backfilling of immersed tubes to be implanted, disposing a grouting tube capable of outputting solidifiable slurry in a furrow below immersed tubes;

after the locked backfilling, grouting the immersed tubes by using the grouting tube.

By use of a cavity formed by combining a backfill and the inner wall of the furrow after the locked backfilling, as the grouting tube is disposed before the cavity is formed, grouting is carried out in the cavity, as shown in FIG. 2. Pressure generated by the grouting may jack up the immersed tubes (during jacking up, the postures of the immersed tubes may be adjusted by adjusting the grouting amounts at different positions in the furrow), thereby under the condition mentioned in the background art that the postures and the heights of the immersed tubes do not accord with the standard due to abnormal settlements of gravel mattresses or a geologic structure thereunder, the postures of the immersed tubes may be adjusted more efficiently, and the installation position heights of the immersed tubes may meet a design requirement by jacking up the immersed tubes; in addition, after the grouting, the gravel mattresses may become more compact, and would support the immersed tubes more stably during later use of the immersed tubes, the settlement problem mentioned in the background art is difficult to cause, and the service lives of structures at connection positions of the immersed tubes and adjacent immersed tubes (including connection positions of a "sandwich immersed tube structure" and the adjacent immersed tubes) are longer, in addition, as mentioned above, after the grouting, the gravel mattresses may be prepressed and compacted (after the furrow is fully filled with the slurry, more grouting may be carried out to a certain extent to prepress and compact the gravel mattresses), so that the gravel mattresses may have prestress inside and provide the prestress for the bottoms of the immersed tubes which then may achieve the better bearing effect on the load during use.

As a preferred scheme of the present application, the grouting tube is disposed in the furrow before implantation of the immersed tubes, so that the construction is more convenient, the possibility of interference generated by all structures during construction is reduced, and the efficiency is higher.

As a preferred scheme of the present application, a pressure sensor is disposed in the furrow before implantation of the immersed tubes;

when the grouting tube is carrying out grouting, the pressure sensor is used to monitor a pressure change in the furrow, and what is monitored by the pressure sensor is a pressure of an installation position. Several pressure sensors mutually cooperate to judge a grouting condition according to the pressure change, and cooperate with other monitoring measures during adjustment of the immersed tubes to better install the immersed tubes.

As a preferred scheme of the present application, the furrow for installing the grouting tube is a large furrow which is formed by the edges of two gravel mattresses and is below an immersed tube joint. The slurry moves towards two sides of the large furrow from the middle of the large furrow during grouting, and then flows towards clearances between the gravel mattresses and the immersed tubes after the large furrow is full (during the flowing in the axial direction of the immersed tubes, slurry flow may be finally stopped by increased flowing resistance of slurry flow due to certain deformations of the upper surfaces of the gravel mattresses under pressure, increase of a friction force, and solidification of the slurry), so that the gravel mattresses filled with the slurry may achieve a supporting effect on the immersed tubes. The grouting tube is used to carry out the grouting at positions, where the gravel mattresses are prone to settle, around the large furrow, so that the settlement problem may be solved more effectively; and in addition, the large furrow has a relatively large space, which facilitates installation of the grouting tube and relevant assorted devices.

As a preferred scheme of the present application, the tops of the gravel mattresses have small furrows smaller than the large furrows. Before the locked backfilling of the immersed tubes, stop components for filling the small furrows are disposed in the small furrows, and may better fill the large furrow with the slurry; in addition, the gravel mattresses, between which the large furrow extends certain distances towards two sides, also may be better filled with the slurry and better prepressed and compacted (till the large furrow and all the small furrows between the stop components on two sides of the large furrow are full, and then grouting is continued to realize certain prepressing); and therefore, before the slurry is solidified, the adjustment effect on the immersed tubes is better, and after the slurry is solidified, the supporting effect and the anti-settling effect on the immersed tubes are better.

As a preferred scheme of the present application, the stop components are disposed in the small furrows before implantation of the immersed tubes, so that the construction is more convenient, the possibility of interference generated by all structures during construction is reduced, and the efficiency is higher.

As a preferred scheme of the present application, the stop components are air bags which are convenient to install, and may fill up spaces in the small furrows as much as possible and have a better stop effect on the slurry.

As a preferred scheme of the present application, flexible spacer layers are disposed between the air bags and the inner walls of the small furrows to protect the air bags and prevent the air bags from being damaged by the gravel mattresses and leaking air, and also may further improve the stop effect on the slurry.

As a preferred scheme of the present application, the flexible spacer layers are geotextiles with high economical efficiency, and the geotextiles which are common in construction are readily available.

As a preferred scheme of the present application, the solidifiable slurry is concrete.

As a preferred scheme of the present application, after implantation of the immersed tubes, before the locked backfilling, sealing components for preventing the solidifiable slurry from flowing out of two ends of the large furrow are firstly disposed in openings at the two ends of the large furrow respectively, and then the locked backfilling is carried out. As the sealing effect of materials for locked backfilling on the slurry in the furrow is not optimized enough, during grouting, particularly after the furrow is fully filled with the slurry, grouting is continued for prepressing and compaction, and the slurry may possibly penetrate through the locked backfilling material of the openings at the two ends of the large furrow, but the disposed sealing components may better guarantee the filling and prepressing effects of the slurry on the large furrow and the small furrows.

As a preferred scheme of the present application, the sealing components are sandbags which are high in economical efficiency and convenient to machine.

As a preferred scheme of the present application, a bracket is disposed outside the grouting tube. The grouting tube is installed in the large furrow by the bracket. After the furrow is filled with the slurry, the slurry may wrap the bracket, and form a structure with relatively high rigidity and intensity after solidification, so that the supporting effect on the immersed tubes is better and more stable, and the possibility of occurrence of the abnormal settlement is lower, and in addition, the disposal of the bracket outside the grouting tube may also reserve an enough grouting space outside the circumferential surface of the grouting tube after the grouting tube is installed into the large furrow, thus achieving a better grouting effect.

As a preferred scheme of the present application, openings in different orientations are formed in the grouting tube. During grouting, the grouting tube simultaneously grouts two axial sides of the large furrow, so that the grouting effect on the furrow is better, the slurry are diffused towards the two sides more symmetrically, and the stress effects of the adjacent immersed tubes are more symmetric.

As a preferred scheme of the present application, after implantation of the immersed tubes, and before locked backfilling, the sealing components are disposed at the two ends of the large furrow, and also are disposed on the outer sides of the gravel mattresses between the large furrow and the small furrows for installing the stop components.

The present application further discloses a post-grouting method for bases of joints of a final joint and adjacent immersed tubes, including:

before locked backfilling of the final joint, disposing grouting tubes capable of outputting solidifiable slurry in furrows below the final joint;

after the locked backfilling of the final joint, grouting the final joint by using the grouting tubes.

By use of a cavity formed by combining a backfill and the inner wall of each furrow after the locked backfilling, as the grouting tubes are disposed before the cavities are formed, grouting is carried out in the cavities. Pressure generated by the grouting may jack up the final joint (during jacking up, the postures of the immersed tubes may be adjusted by adjusting the grouting amounts at different positions in the furrows), thereby under the condition mentioned in the background art that the posture and the height of the final joint do not accord with the standard due to settlements of gravel mattresses or a geologic structure thereunder, the postures of the immersed tubes may be adjusted more efficiently, and the installation position height of the final joint may meet a design requirement by jacking up the final joint; in addition, it is really hard to joint the final joint with the end portions of immersed tubes installed at two ends of the final joint (corresponding gravel mattresses are disposed below the final joint and the immersed tubes at the two ends), so that the final joint is lighter than the immersed tubes at the two ends; after the locked backfilling, the furrows are grouted, and the jacking effect caused by grouting on the final joint is more sensitive and more obvious than that on the immersed tubes at the two ends, so that the final joint is easier to adjust.

In addition, after the grouting, the gravel mattresses become more compact, and would support the final joint more stably during later use of the final joint, the settlement problem mentioned in the background art is difficult to cause, and the service lives of structures at connection positions of the final joint and the adjacent immersed tubes are longer, in addition, as mentioned above, after the grouting, the gravel mattresses may be prepressed and compacted (after the furrows are fully filled with the slurry, more grouting may be carried out to a certain extent to prepress and compact the gravel mattresses), so that the gravel mattresses may have prestress inside and provide the prestress for the bottom of the final joint which then may achieve a better bearing effect on a load during use.

As a preferred scheme of the present application, the grouting tubes are disposed in the furrows before implantation of the final joint.

As a preferred scheme of the present application, pressure sensors are disposed in the furrows before implantation of the final joint;

when the grouting tubes are carrying out grouting, the pressure sensors are used to monitor pressure changes in the furrows.

As a preferred scheme of the present application, furrows for installing the grouting tubes are two large furrows which are formed by the edges of three gravel mattresses and are below the joints of the final joint and the adjacent immersed tubes. There are totally three gravel mattresses: one is correspondingly disposed below the final joint, and the other two are correspondingly disposed below the immersed tubes jointed to the two ends of the final joint.

As a preferred scheme of the present application, the tops of the gravel mattresses have small furrows smaller than the large furrows. Before the locked backfilling of the final joint, stop components for filling the small furrows are disposed in the small furrows.

As a preferred scheme of the present application, the stop components are disposed in the small furrows before implantation of the final joint.

As a preferred scheme of the present application, the stop components are air bags.

As a preferred scheme of the present application, flexible spacer layers are disposed between the air bags and the inner walls of the small furrows.

As a preferred scheme of the present application, the flexible spacer layers are geotextiles.

As a preferred scheme of the present application, the solidifiable slurry is concrete.

As a preferred scheme of the present application, after implantation of the final joint, before the locked backfilling, sealing components for preventing the solidifiable slurry from flowing out of two ends of each large furrow are firstly disposed in openings at the two ends of the large furrow respectively, and then the locked backfilling is carried out.

As a preferred scheme of the present application, the sealing components are sandbags.

As a preferred scheme of the present application, brackets are disposed outside the grouting tubes.

The grouting tubes are installed in the large furrows by the brackets.

As a preferred scheme of the present application, openings in different orientations are formed in the grouting tubes. During grouting, the grouting tubes simultaneously grout two axial sides of the large furrows.

As a preferred scheme of the present application, after implantation of the final joint, and before locked backfilling, the sealing components are disposed at the two ends of the large furrows, and also are disposed on the outer sides of the gravel mattresses between the large furrows and the small furrows for installing the stop components.

As a preferred scheme of the present application, the grouting tubes are respectively disposed in the large furrows below the joints of the final joint and the immersed tubes at the two ends.

The grouting tubes in the two large furrows simultaneously carry out grouting.

The present application has the beneficial effects as follows:

By use of the cavity formed by combining the backfill and the inner wall of the furrow after the locked backfilling, as the grouting tube is disposed before the cavity is formed, grouting is carried out in the cavity. Pressure generated by the grouting may jack up the immersed tubes (during jacking up, the postures of the immersed tubes may be adjusted by adjusting the grouting amounts at different positions in the furrow), thereby under the condition mentioned in the background art that the postures and the heights of the immersed tubes do not accord with the standard due to abnormal settlements, the postures of the immersed tubes may be adjusted more efficiently, and the installation position heights of the immersed tubes may meet a design requirement by jacking up the immersed tubes; in addition, after the grouting, the gravel mattresses may become more compact, and would support the immersed tubes more stably during later use of the immersed tubes, the settlement problem mentioned in the background art is difficult to cause, and the service lives of structures at connection positions of the immersed tubes and the adjacent immersed tubes (including the connection positions of the "sandwich immersed tube structure" and the adjacent immersed tubes) are longer, in addition, as mentioned above, after the grouting, the gravel mattresses may be prepressed and compacted, so that the gravel mattresses may have prestress inside and provide the prestress for the bottoms of the immersed tubes which then may achieve the better bearing effect on the load during use.

REFERENCE NUMBERS IN THE DRAWINGS ARE AS FOLLOWS

1—immersed tube, 2—large furrow, 3—small furrow, 4—air bag, 5—grouting tube, 6—bracket, 7—I-shaped steel, 8—vertical grouting tube, 9—sealing component, 10—formed locked backfill, 11—sea level, 12—final joint, 13—gravel mattress, and 14—pressure sensor.

DETAILED DESCRIPTION OF THE INVENTION

A further detailed description is made to the present application in combination with embodiments and specific implementation modes below, but it should not understand that the scope of the subject of the present application is merely limited by the embodiments below, and all those technologies implemented on the basis of contents of the present application shall fall within the scope of the present application.

Embodiment 1

Figure 1:
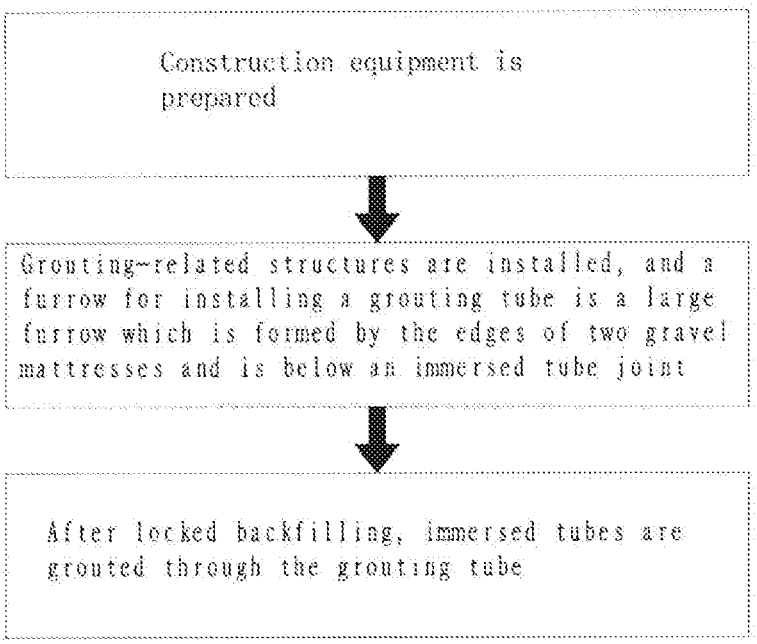
FIG. 1 is a flow chart of grouting of Embodiment 1 of the present application.
Figure 3:
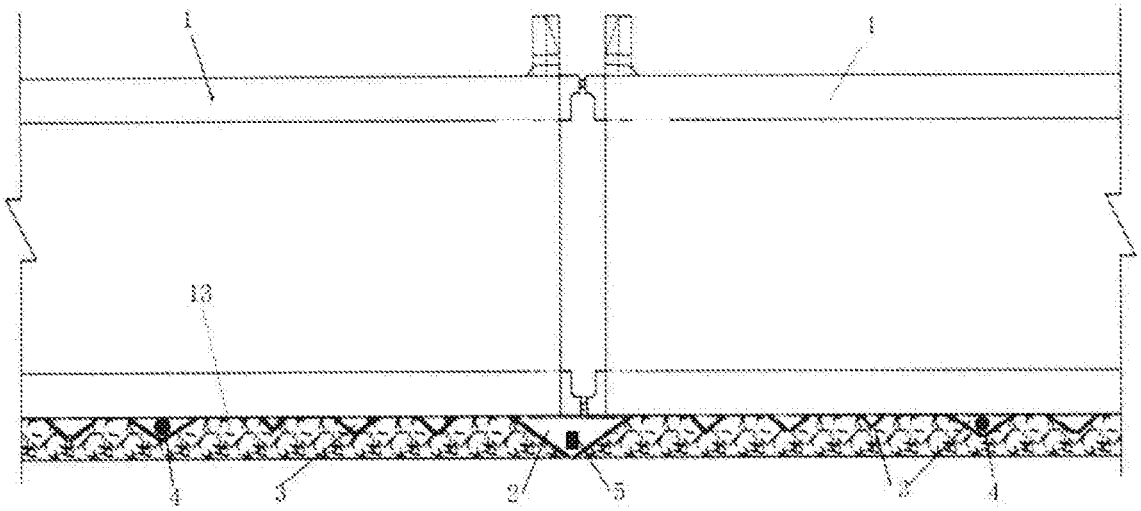
FIG. 3 is a side view of installation of immersed tubes before grouting of Embodiment 1 of the present application.
Figure 4:
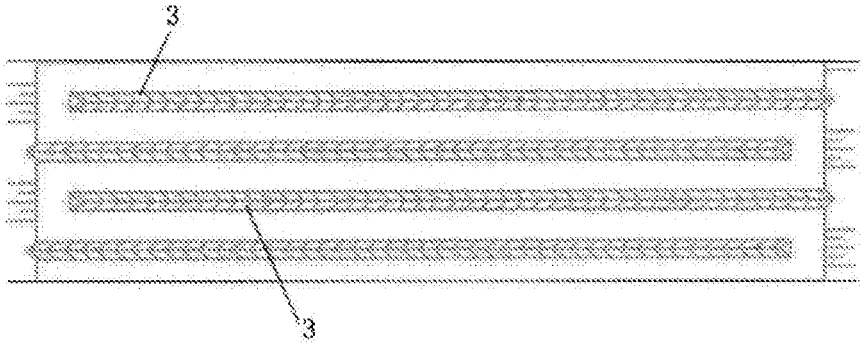
FIG. 4 is a top view of a structure of a small furrow of the present application.

As shown in FIG. 1 and FIG. 3, this embodiment discloses a post-grouting method for an immersed tube joint base, including:

A. Construction equipment is prepared: mortar production and pumping equipment, concrete production and pumping equipment and auxiliary ship engine equipment are disposed at a construction position; mortar produced by a mixing ship is conveyed to a construction platform through a concrete transfer pump and a placing boom which are equipped on the ship, and then is injected into a mortar storage mixing tank which has a disturbance function and a volume of 1 $m^3$; the mixing tank is connected with grouting pumps through pipelines for feeding; two grouting pumps may meet a requirement for the conveying flow of 8 $m^3$/h; it is planned that the concrete production and pumping equipment is a mixing ship which has the functions of raw material storage, ship anchor mooring positioning and the like besides the concrete production and pumping performance; an aggregate storage bin of the ship may load 1,800 $m^3$ of materials, and a filler bin may load 600 $m^3$ of materials, so that 1,000 $m^3$ of concrete may be poured by once stocking in the ship; three trailer pumps are installed on the construction platform; each trailer pump has a theoretical displacement of 57 $m^3$/h; and an extra towboat with power of 3,600 hp and an extra anchor boat with power of 900 hp and rated unmooring capacity of 10 t need to be provided for realizing waterborne movement, anchoring positioning of the concrete mixing ship.

Figure 5:
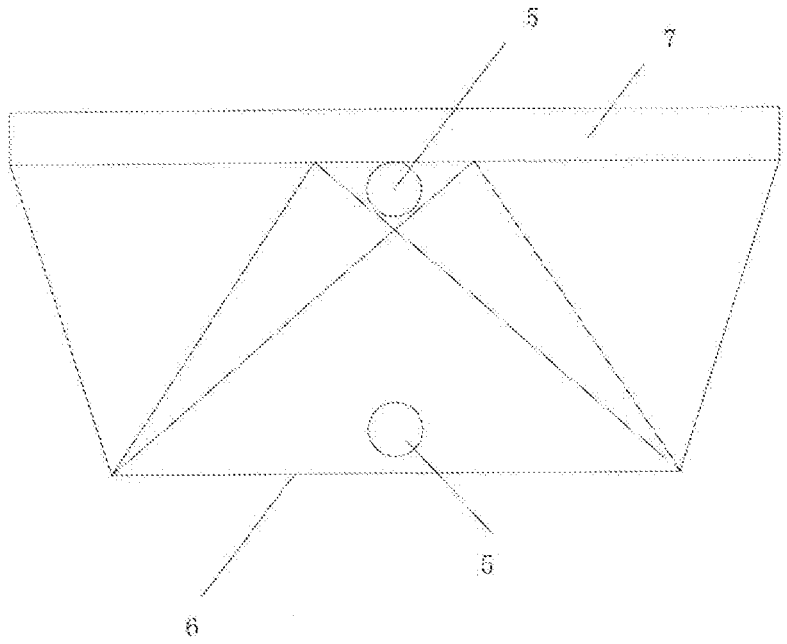
FIG. 5 is a schematic diagram of structures of a grouting tube and a bracket of Embodiment 1 of the present application.
Figure 6:
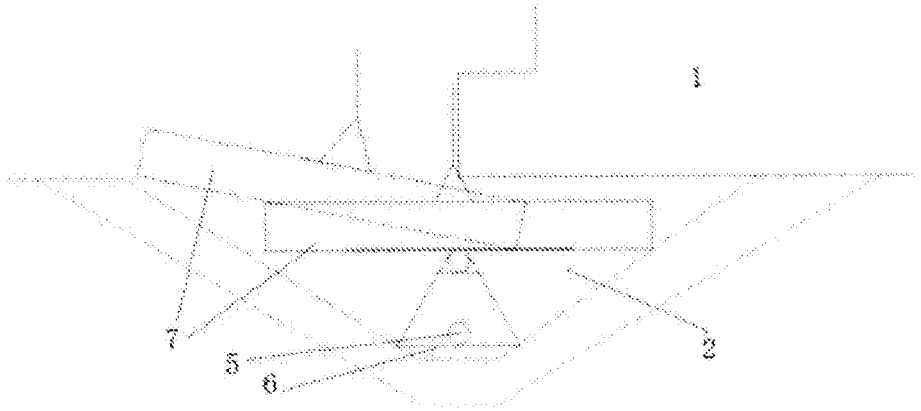
FIG. 6 is a schematic diagram of hoisting of a grouting tube of Embodiment 1 of the present application.
Figure 7:
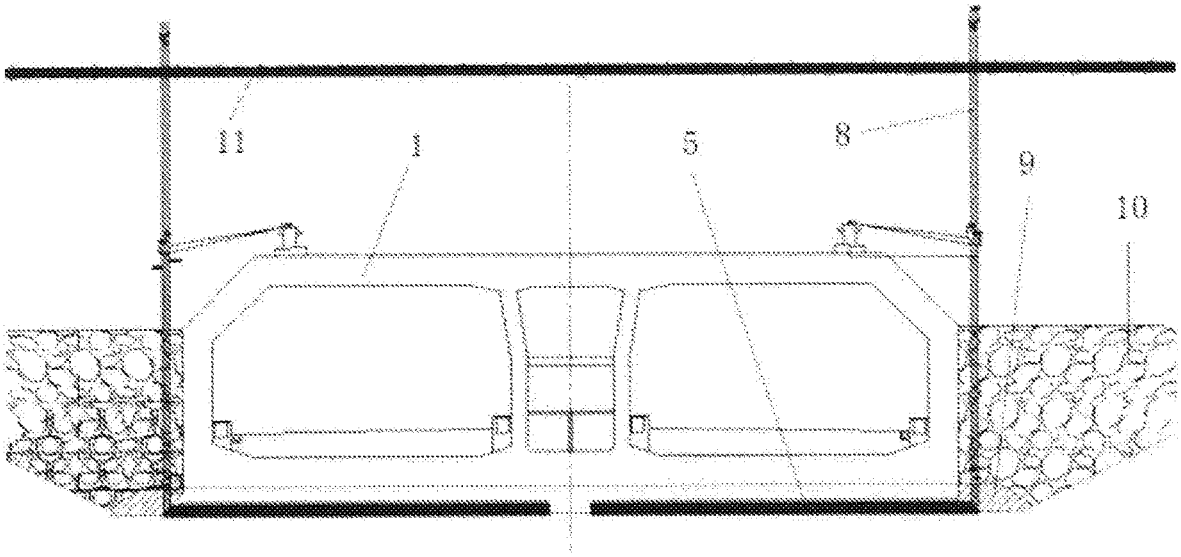
FIG. 7 is a sectional view of installation of immersed tubes of Embodiment 1 of the present application.

B. Grouting-related structures are installed: furrows for installing grouting tubes 5 are three large furrows 2 which are placed below joints of immersed tubes 1 and are formed by edges of three gravel mattresses 13; the tops of the gravel mattresses 13 have small furrows 3 smaller than the large furrows 2; before locked backfilling of the immersed tubes 1 to be implanted (in this embodiment, specifically before implantation of the immersed tubes 1), the grouting tubes 5 capable of outputting solidifiable slurry are disposed in the furrows below the immersed tubes 1 along the ditch directions of the furrows (as shown in FIG. 5, the slurry is concrete; brackets 6 are disposed outside the grouting tubes 5, so that the grouting tubes 5 may be installed in the large furrows 2 by the brackets 6; the grouting tubes 5 are fixed on the brackets 6; during installation, the brackets 6 are hoisted through hoisting equipment; openings in different orientations are formed in the grouting tubes 5, so that during grouting, the grouting tubes 5 may simultaneously grout two axial sides of the large furrows 2); there are four grouting tubes 5 in total; two groups of grouting tubes 5 are symmetrically disposed on two axial sides of the immersed tubes 1, and each group includes two grouting tubes 5; the two grouting tubes 5 in the same group are distributed in parallel up and down; during subsequent grouting, the two bottom grouting tubes 5 pump the concrete through the trailer pumps, and the two top grouting tubes 5 inject cement mortar into the furrows through the grouting pumps (not limited to the cement mortar, but concrete is also acceptable); each horizontal grouting tube 5 is 18 m in length, 125 mm in diameter and 5 mm in wall thickness; there are two brackets 6 (the brackets 6 are of inverted triangular prism structures parallel to the grouting tubes 5 in the axial direction; a plurality of pieces of horizontally installed I-shaped steel 7 perpendicular to the axial directions of the brackets 6 are fixed at the tops of the brackets 6; two ends of the I-shaped steel 7 are connected with two ends of a rod piece at the bottom of the bracket 6 through a connecting piece to achieve higher intensity; an axial distance between adjacent pieces of I-shaped steel on each bracket 6 is 1.2 m, and there are 16 pieces of I-shaped steel on each bracket 6; after installation, the highest position at the top end of each bracket 6, namely the top of the I-shaped steel, is lower than the top surface of the furrow top of each large furrow 2; in addition, the I-shaped steel and the brackets 6 are in horizontal states; as shown in FIG. 6, during installation, the immersed tube 1 on one side of the furrows 2 has been installed, but the immersed tube 1 to be implanted has not been installed yet, so that the brackets 6 need to enter the furrows in a tilting manner in a descending process, and then is adjusted to be leveled after entering the furrows), the two brackets 6 respectively correspond to the two groups of grouting tubes 5; four grouting holes (namely the above-mentioned openings) are formed in each top grouting tube 5, and has a diameter of about 4.5 cm; outwards extending pipelines are disposed on the grouting holes; two grouting positions are set on each bottom grouting tube 5, and three grouting holes are formed in each position, have a size of 10 cm*3 cm, and are distributed on the same section in a trisection manner, pressure sensors 14 are disposed in the furrows (the pressure sensors 14 are pressure cells, and in this embodiment, they are high-precision vibrating wire type earth pressure cells having effects as follows: during grouting of the grouting tubes 5, the pressure sensors 14 are used to monitor pressure changes in the furrows; five pressure cells are disposed at the ditch bottom in each large furrow 2 along the axial direction of the furrow in an equal spacing manner, and are installed on the upper surfaces of profiles at the bottoms of the brackets 6; in addition, on one side of each large furrow 2, one pressure cell is disposed between the large furrow 2 and the small furrows 3 with air bags 4, and one pressure cell is disposed beside the small furrows 3 for installing the air bags 4 towards a direction away from the large furrow 2; on the other side of the large furrow 2, two pressure cells are symmetrically disposed according to this scheme, that is, four pressure cells in total; a connection line of the four pressure cells is parallel to the axial lines of the immersed tubes 1; the pressure cells are connected with data lines which extend towards the outsides of the gravel mattresses 13, thus facilitating transmission of data measured by the pressure cells during subsequent grouting); the gravel mattress 13 of each immersed tube 1 has a designed width of 42.95 m and a thickness of 1.3 m; each furrow top has a width of 1.8 m, and each furrow has a width of 1.05 m;

before the locked backfilling of the immersed tubes 1 (in this embodiment, specifically before implantation of the immersed tubes 1, the end portions of two immersed tubes 1 may be simultaneously backfilled during locked backfilling); stop components for filling the small furrows 3 are disposed in the small furrows 3 (in this embodiment, the stop components are the air bags 4, but not limited to the air bags 4); before installation of the air bags 4, they are subjected to a pressing test at a test pressure of 0.24 Mpa; flexible spacer layers are disposed between the air bags 4 and the inner walls of the small furrows 3 (in this embodiment, the flexible spacer layers consist of geotextiles, but not limited to the geotextiles); at least six small furrows 3 are disposed on two sides of the large furrows 2 side by side; the flexible spacer layers are disposed on the inner surfaces of the fifth and sixth small furrows 3 and at the furrow top between the fifth and sixth small furrows 3 (before disposal of the flexible spacer layers, positions, which are to be equipped with the flexible spacer layers, on the surfaces of the gravel mattresses 13 are subjected to gravel finishing, so that irregular bulge structures are reduced, possible damage caused by bulges to the air bags 4 after the flexible spacer layers are paved is prevented, and the influence on the stop effect on the slurry is also avoided; after being subjected to the gravel finishing, the small furrows 3 have a depth of about 15 cm); each flexible spacer layer consists of two layers of geotextiles, and is fixed by heavy objects such as an iron chain or gravels; after the flexible spacer layers are disposed, the air bags 4 are installed; the gravel mattresses 13 are exposed from connection ports at the end portions of the air bags 4; installation of the air bags 4 and installation of the grouting tubes 5 may be exchanged or simultaneously carried out; after the air bags 4 and the grouting tubes 5 are both installed, the air bags 4 are connected with air tubes which are connected with an external air compressor, and the grouting tubes 5 (namely the above-mentioned grouting tubes 5) in the furrows are correspondingly connected with vertical grouting tubes 8 vertically disposed in the sea (the installation time of the vertical grouting tubes 8 is set before the connection between the grouting tubes 5 in the furrows and the vertical grouting tubes 8); as shown in FIG. 7, the vertical grouting tubes 8 extend out of the sea level 11; the corresponding vertical grouting tubes 8 are correspondingly connected with the concrete production and pumping equipment or the mortar production and pumping equipment (the grouting tubes 5 in one furrow corresponds to one vertical grouting tube 8); the vertical grouting tubes 8 are connected with the immersed tubes 1 through steel wires, thus reducing the influence of flowing of seawater on the vertical grouting tubes 8; in addition, the vertical grouting tubes 8 are connected with two floating balls to adjust negative buoyance;

after implantation of the immersed tubes 1, and before the locked backfilling, sealing components 9 (which are sandbags in this embodiment, but not limited to the sandbags) for preventing the solidifiable slurry from flowing out of two ends of the large furrows 2 are firstly disposed in openings at the two ends of the large furrows 2, and in addition, sealing components 9 for preventing the solidifiable slurry from flowing out are also disposed on the outer sides of the gravel mattresses 13 between the large furrows 2 and the small furrows 3 for installing the stop components; then the locked backfilling is carried out; and during the backfilling, bending or breakage of the vertical grouting tubes 8 due to fast backfilling should be prevented.

C. After the locked backfilling of the immersed tubes 1 (as shown in FIG. 7, formed locked backfills 10 wrap the sealing components 9), the grouting tubes 5 are used to carry out the grouting, and a designed grouting amount for the large furrows 2 is about 150 $m^3$ (in consideration of spreading of the slurry along longitudinal and transverse directions, the initial amount is 300 $m^3$); the slurry accords with the conditions as follows: after 3 days, its intensity is not more than 0.5 Mpa, and its long-term intensity ranges from 1.0 Mpa to 1.5 Mpa; the slurry may have underwater non-separation resistance as it needs to be transported at a long distance; when an uneven foundation is filled with the slurry, small bleeding and a small foundation permeation amount are caused; delayed solidification time is not shorter than 72 hours; and the slurry may be suitable for a pumping distance of 200 meters or a longer distance.

Figure 2:
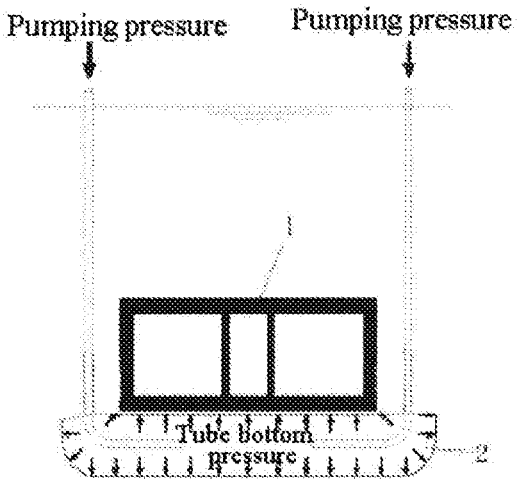
FIG. 2 is a schematic diagram of Embodiments 1 and 2 of the present application.

To be more specific, in the first stage, namely the concrete grouting stage, the bottom grouting tubes 5 of the two groups of grouting tubes 5 are used to carry out grouting simultaneously; during the grouting, the concrete discharging speed of the trailer pumps is controlled at 30 $m^3$/h, and the total time does not exceed 10 h; in order to monitor a concrete grouting pressure, it needs to install pressure meters at waterborne elbow positions of the vertical grouting tubes connected with the pumps;

In order to guarantee maximized filling of the bottoms of the immersed tubes 1, a second stage is carried out: after concrete grouting is completed, mortar is grouted immediately in a way basically consistent with the concrete pouring, but after the grouting is completed, it needs to use the trailer pumps to stabilize the pressure; during the concrete grouting, values on the pressure cells and level gauges (which are installed on the immersed tubes 1) are recorded all the time; when the total amount is about to reach a designed amount, it needs to slow down the grouting (in the pressure stabilizing process, it needs to use the mortar pumps to continuously compensate the pressure till the values on the pressure meters are stable); if the values on the pressure meters and the pressure cells are increased to approach target values or change suddenly, the grouting is stopped immediately; in the pressure stabilizing process, 20 $m^3$ of mortar is needed in total; during the grouting, as the pressure cell has limited test precision, and the influence of the slurry on the pressure cells is approximate to the order of influence of a tide level and the density of the seawater, relevant data need to be collected in the grouting pressure monitoring process; meanwhile, the tide level monitoring data frequency should be the same as the monitoring frequency of the pressure meters, and the measurement precision is up to 0.1 m; in addition, during grouting, the postures and the heights of the immersed tubes 1 need to be monitored, and may be adjusted by adjusting the grouting amounts at different positions according to data of the pressure cells, and the principle is as shown in FIG. 2; and tube bottom pressure, which is generated by a pumping pressure through the grouting in the furrows 2, of the immersed tubes 1 jacks up the immersed tubes 1.

Embodiment 2

Figure 8:
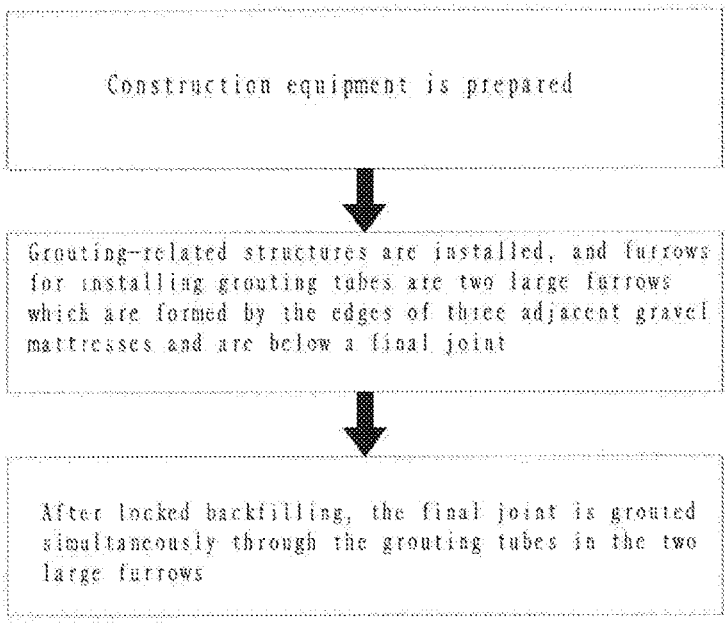
FIG. 8 is a flow chart of grouting of Embodiment 2 of the present application.
Figure 9:
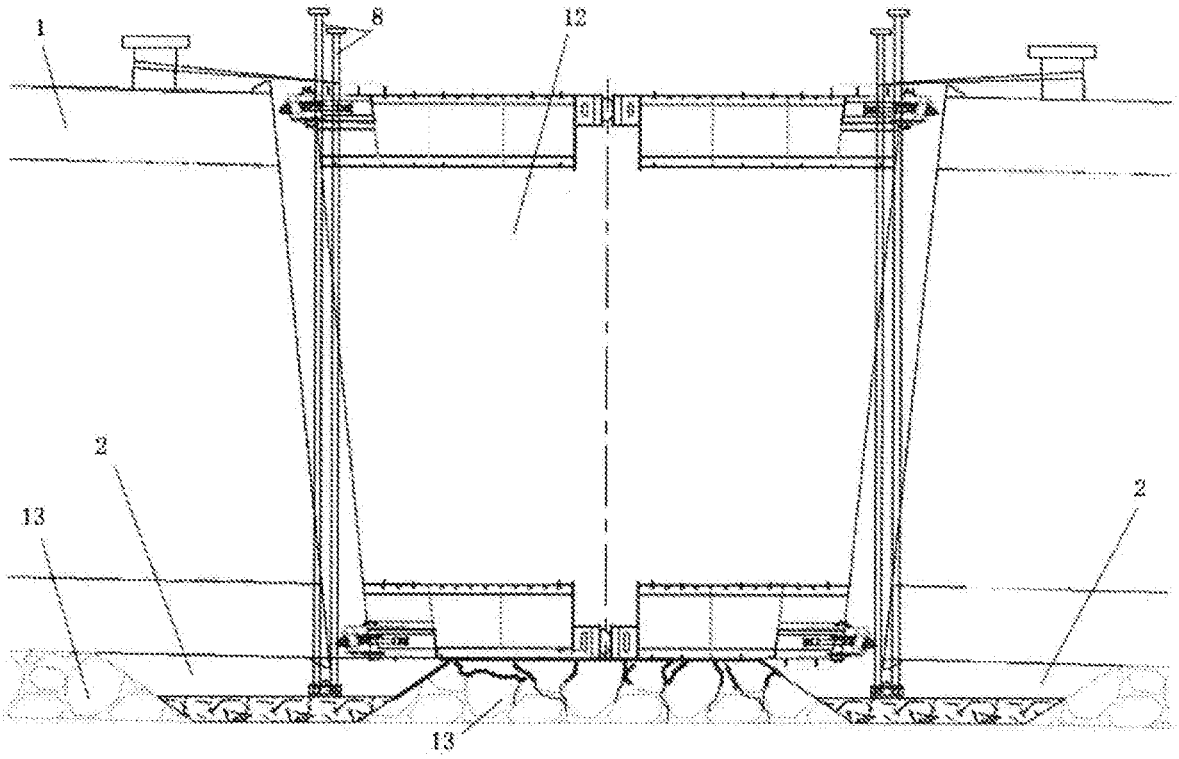
FIG. 9 is a side view of installation of a final joint before grouting of Embodiment 2 of the present application.

As shown in FIG. 8 and FIG. 9, this embodiment discloses a post-grouting method for bases of joints of a final joint and adjacent immersed tubes, including:

A. Construction equipment is prepared: concrete production and pumping equipment and auxiliary ship engine equipment are disposed at a construction position; it is planned that the concrete production and pumping equipment includes two mixing ships which have properties of raw material storage, ship anchor mooring positioning and the like besides the concrete production and pumping performance; an aggregate storage bin of each ship may load 1,800 $m^3$ of materials, and a filler bin may load 600 $m^3$ of materials, so that 2,000 $m^3$ of concrete may be poured by once stocking in the two ships, and may completely meet a requirement for pouring of base slurry; six trailer pumps (two for standby application) are installed on the construction platform; each trailer pump has a theoretical displacement of 90 $m^3$/h; and an extra towboat with power of 3,600 hp and an extra anchor boat with power of 900 hp and rated unmooring capacity of 10 t need to be provided for realizing waterborne movement, anchoring positioning of the concrete mixing ships.

Figure 10:
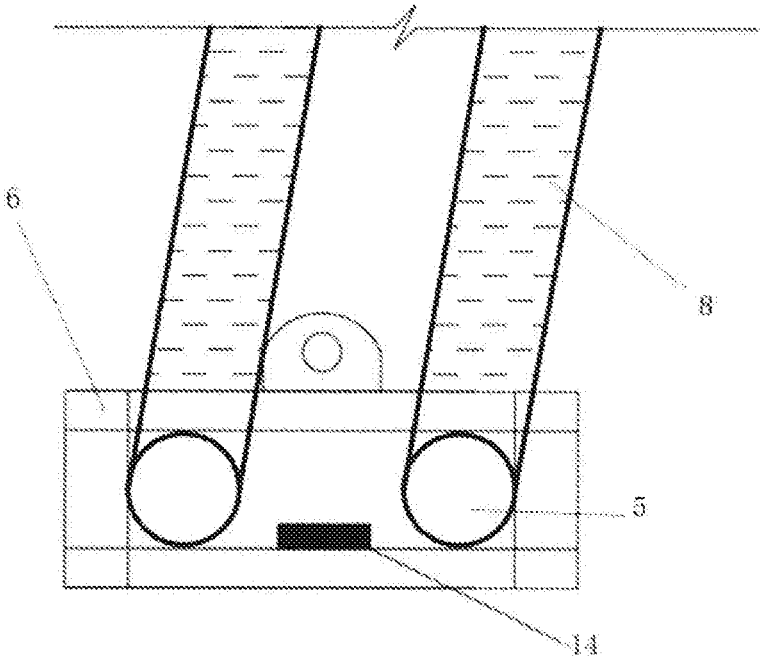
FIG. 10 is a schematic diagram of structures of a grouting tube and a bracket of Embodiment 2 of the present application.

B. Grouting-related structures are installed: furrows for installing grouting tubes 5 are two large furrows 2 which are placed below the final joint 12 and are formed by edges of three adjacent gravel mattresses 13; the tops of the gravel mattresses 13 have small furrows 3 smaller than the large furrows 2; before locked backfilling of the final joint 12 to be implanted (in this embodiment, specifically before implantation of the final joint 12), the grouting tubes 5 capable of outputting solidifiable slurry are disposed in the furrows below the final joint 12 (the slurry is concrete; as shown in FIG. 10, brackets 6 are disposed outside the grouting tubes 5, so that the grouting tubes 5 may be installed in the large furrows 2 by the brackets 6; the grouting tubes 5 are fixed on the brackets 6; during installation, the brackets 6 are hoisted through hoisting equipment; as a corresponding gravel mattress is disposed below the final joint 12, and corresponding gravel mattresses are disposed below the immersed tubes 1 jointed at two ends of the final joint 12, the two large furrows 2 are formed by the clearances of the three gravel mattresses 13; openings in different orientations are formed in the grouting tubes 5, so that during grouting, the grouting tubes 5 may simultaneously grout two axial sides of the large furrows 2);

there are four grouting tubes 5 in each large furrow 2; two groups of grouting tubes 5 are symmetrically disposed on two axial sides of the immersed tubes 1, and each group includes two grouting tubes 5; the two grouting tubes 5 in the same group are distributed in parallel at the same height; during subsequent grouting, only one of the two grouting tubes 5 in the same group carries out grouting, and the other one is standby and is started when the grouting tube 5 in a grouting state is blocked; in addition, the grouting tubes 5 in the grouting states on different sides in each large furrow 2 are staggered from each other to guarantee compact and full flowing of the slurry; there are four brackets 6 (as shown in FIG. 10, the brackets 6 are of cuboid structures parallel to the grouting tubes 5 in the axial direction, and are about 25 cm in height, and their bottom edges are about 60 cm in width; an outer frame of each bracket is made of 8# channel steel, and is connected and reinforced through 5# angle steel); the four brackets respectively correspond to the four groups of grouting tubes 5 in the two furrows 2; two grouting positions are set on each bottom grouting tube 5, and three grouting holes are formed in each position, have a size of 10 cm*3 cm, and are distributed on the same section in a trisection manner; each horizontal grouting tube 5 (the grouting tubes 5 in the furrows) is 18 m in length, 125 mm in diameter and 8 mm in wall thickness;

pressure sensors 14 are disposed in the furrows (the pressure sensors 14 are pressure cells, and in this embodiment, they are high-precision vibrating wire type earth pressure cells having effects as follows: during grouting of the grouting tubes 5, the pressure sensors 14 are used to monitor pressure changes in the furrows; five pressure cells are disposed at the ditch bottom in each large furrow 2 along the axial direction of the furrow in an equal spacing manner, and are installed on the upper surfaces of profiles at the bottoms of the brackets 6; there are ten pressure cells in the two large furrows 2 in total; in addition, on one side, which is opposite to the final joint 12, of each large furrow 2, two pressure cells are disposed between the large furrow 2 and the small furrows 3 for installing air bags 4, and one pressure cell is disposed beside the small furrows 3 for installing the air bags 4 towards a direction away from the large furrow 2; two pressure cells are disposed on the gravel mattress 13 below the final joint 12, that is, there are eight pressure cells on the gravel mattresses 13 at the installation position; a connection line of the eight pressure cells is parallel to the axial lines of the immersed tubes 1; the pressure cells are connected with data lines which extend towards the outsides of the gravel mattresses 13, thus facilitating transmission of data measured by the pressure cells during subsequent grouting);

before the locked backfilling of the final joint 12 (in this embodiment, specifically before implantation of the final joint 12, the final joint 12 and the end portions of two immersed tubes 1 jointed with the final joint 12 are simultaneously backfilled during locked backfilling); stop components for filling the small furrows 3 are disposed in the small furrows 3 (in this embodiment, the stop components are the air bags 4, but not limited to the air bags 4); flexible spacer layers are disposed between the air bags 4 and the small furrows 3 (in this embodiment, the flexible spacer layers consist of geotextiles, but not limited to the geotextiles); before installation of the air bags 4, they are subjected to a pressing test at a test pressure of 0.24 Mpa; at least seven small furrows 3 are disposed on two sides of the large furrows 2 side by side (the small furrows 3 are not the small furrows on the gravel mattress 13 below the final joint 12); each air bag 4 is 23 m in length, 40 cm in width before inflation, and 25 cm in diameter after inflation; two air bags 4 are overlapped in each small furrow 3 at an overlapping length of about 3 m; the air bags 4 at two ends are basically consistent with the outer side of the gravel mattress 13; the flexible spacer layers are disposed on the inner surface of the seventh small furrow 3 and at the furrow top beside the seventh small furrow 3 (before disposal of the flexible spacer layers, positions, which are to be equipped with the flexible spacer layers, on the surfaces of the gravel mattresses 13 are subjected to gravel finishing, so that irregular bulge structures are reduced, possible damage caused by bulges to the air bags 4 after the flexible spacer layers are paved is prevented, and the influence on the stop effect on the slurry is also avoided; after being subjected to the gravel finishing, the small furrows 3 are about 15 cm in depth); besides the air bags disposed at the two above-mentioned positions in the "seventh small furrow", air bags are also disposed in two small furrows between the two positions in the "seventh small furrow" and the adjacent large furrow; the air bags 4 are installed in eight small furrows in total; each flexible spacer layer consists of two layers of geotextiles, and is fixed by heavy objects such as an iron chain or gravels; after the flexible spacer layers are disposed, the air bags 4 are installed; the gravel mattresses 13 are exposed from connection ports at the end portions of the air bags 4; installation of the air bags 4 and installation of the grouting tubes 5 may be exchanged or simultaneously carried out; after the air bags 4 and the grouting tubes 5 are both installed, the air bags 4 are connected with air tubes which are connected with an external air compressor, and the grouting tubes 5 (namely the above-mentioned grouting tubes 5) in the furrows are correspondingly connected with vertical grouting tubes 8 vertically disposed in the sea (the installation time of the vertical grouting tubes 8 is set before the connection between the grouting tubes 5 in the furrows and the vertical grouting tubes 8); the corresponding vertical grouting tubes 8 are correspondingly connected with the concrete production and pumping equipment (the grouting tubes 5 in one furrow corresponds to one vertical grouting tube 8); the vertical grouting tubes 8 are connected with the immersed tubes 1 through steel wires, thus reducing the influence of flowing of seawater on the vertical grouting tubes 8; in addition, the vertical grouting tubes 8 are connected with two floating balls to adjust negative buoyance;

after implantation of the final joint 12, and before the locked backfilling, sealing components 9 (which are sandbags in this embodiment, but not limited to the sandbags) for preventing the solidifiable slurry from flowing out of two ends of the large furrows 2 are firstly disposed in openings at the two ends of the large furrows 2, and in addition, sealing components 9 for preventing the solidifiable slurry from flowing out are also disposed on the outer sides of the gravel mattresses 13 between two small furrows 3 for installing the stop components; then the locked backfilling is carried out; and during the backfilling, bending or breakage of the vertical grouting tubes 8 due to fast backfilling should be prevented.

C. After the locked backfilling of the final joint 12, the grouting tubes 5 in the two large furrows 2 are used to carry out the grouting simultaneously at a grouting amount of about 550 $m^3$; unsegregated concrete is grouted according to a grouting speed of 30 $m^3$/h, and the expected total grouting time is about 14 hours; the slurry meets the conditions as follows: after 3 days, its intensity is not more than 0.5 Mpa, and its long-term intensity ranges from 1.0 Mpa to 1.5 Mpa; the slurry may have underwater non-separation resistance as it needs to be transported at a long distance; when an uneven foundation is filled with the slurry, small bleeding and a small foundation permeation amount are caused; delayed solidification time is not shorter than 72 hours; and the slurry may be suitable for a pumping distance of 200 meters or a longer distance; the slump degree is 650+/−50 mm; and the maximum aggregate size does not exceed 20 mm.

To be more specific, in the first stage, namely the filling stage, the grouting tubes 5 in the two furrows start to carry out grouting; during the grouting, the concrete discharging speed of the trailer pumps is controlled at 30 $m^3$/h; in order to monitor a concrete grouting pressure, it needs to install pressure meters at waterborne elbow positions of the vertical grouting tubes connected with the pumps;

in order to guarantee maximized filling of the bottoms of the immersed tubes 1, a second stage is carried out, namely a prepressing and compacting stage; the grouting mode is basically consistent with concrete pouring; after filling is completed, the prepressing and compacting stage is carried out: the grouting amounts are continuously adjusted according to readings on the pressure cells and level gauges; during grouting, the concrete grouting pressure is determined according to the pressure meters installed at the waterborne elbow positions; when the pressure has a substantial sudden change, the grouting should be stopped. During grouting, as the pressure cell has limited test precision, and the influence of the slurry on the pressure cells is approximate to the order of influence of a tide level and the density of the seawater, relevant data need to be collected in the grouting pressure monitoring process; meanwhile, the tide level monitoring data frequency should be the same as the monitoring frequency of the pressure meters, and the measurement precision is up to 0.1 m; in addition, during grouting, the postures and the heights of the immersed tubes 1 need to be monitored, and may be adjusted by adjusting the grouting amounts at different positions according to data of the pressure cells.

The invention claimed is:

1. A method for grouting a base of a joint between immersed tubes, the method comprising:

disposing a grouting tube in a furrow between gravel mattresses on an underwater geologic structure, wherein the grouting tube is configured to output a solidifiable slurry;

after disposing the grouting tube, implanting the immersed tubes on the gravel mattresses;

simultaneously backfilling the immersed tubes; and then grouting the base of the joint between the immersed tubes using the grouting tube.

2. The method according to claim 1, further comprising disposing a pressure sensor is in the furrow before implanting the immersed tubes; and when grouting, monitoring a pressure change in the furrow using the pressure sensor.

3. The method according to claim 1, wherein the furrow comprises a large furrow between edges of two adjacent ones of the gravel mattresses.

4. The method according to claim 3, wherein tops of the gravel mattresses have small furrows smaller than the large furrows; and before backfilling the immersed tubes, and the method further comprises disposing stop components in the small furrows, the stop components filling the small furrows.

5. The method according to claim 4, wherein the stop components are disposed in the small furrows before implanting the immersed tubes.

6. The method according to claim 4, wherein the stop components comprise air bags.

7. The method according to claim 6, further comprising disposing flexible spacer layers between the air bags and inner walls of the small furrows.

8. The method according to claim 7, wherein the flexible spacer layers comprise geotextiles.

9. The method according to claim 4, wherein after implanting the immersed tubes and before backfilling the immersed tubes, the method further comprises disposing sealing components in openings at the ends of the large furrow, the sealing components preventing the solidifiable slurry from flowing out of ends of the large furrow.

10. The method according to claim 9, wherein the sealing components comprise sandbags.

11. The method according to claim 4, wherein after implanting the immersed tubes and before backfilling the immersed tubes, the method further comprises disposing sealing components at ends of the large furrow and on outer sides of the gravel mattresses between the large furrow and the small furrows.

12. The method according to claim 3, further comprising disposing a bracket outside the grouting tube; wherein disposing the grouting tube comprises installing the grouting tube in the large furrow by the bracket.

13. The method according to claim 1, wherein the solidifiable slurry is concrete.

14. The method according to claim 1, further comprising forming openings in different orientations in the grouting tube; wherein grouting the immersed tubes comprises simultaneously grouting two axial sides of the large furrow using the grouting tube.

15. A method for grouting a base of a final joint between immersed tubes, the method comprising:

disposing a plurality of grouting tubes in furrows between gravel mattresses on an underwater geologic structure, wherein the plurality of grouting tubes are configured to output a solidifiable slurry, the furrows comprise (i) a first large furrow between edges of first and second ones of the gravel mattresses, (i) a second large furrow between edges of the second one of the gravel mattresses and a third one of the gravel mattresses, and (iii) small furrows in a top of the gravel mattresses, the small furrows being smaller than the large furrows;

disposing stop components in the small furrows, wherein the stop components fill the small furrows;

after disposing the stop components, simultaneously backfilling the final joint and the immersed tubes; and then grouting the base of the final joint and the immersed tubes using the plurality of grouting tubes.

16. The method according to claim 15, further comprising, after disposing the grouting tubes, implanting the final joint and the immersed tubes on the gravel mattresses.

17. The method according to claim 15, wherein first and second ones of the grouting tubes are respectively disposed in the first and second large furrows grouting the base of the final joint and the immersed tubes comprises simultaneously outputting the solidifiable slurry using the first and second grouting tubes in the first and second large furrows.

18. The method according to claim 16, wherein after implanting the final joint and the immersed tubes, and before backfilling the final joint and the immersed tubes, the method further comprises disposing sealing components at ends of the large furrows and on outer sides of the gravel mattresses between the large furrows and the small furrows.

19. A method for grouting a base of a joint between immersed tubes, the method comprising:

disposing a grouting tube in a furrow between gravel mattresses on an underwater geologic structure, wherein the grouting tube is configured to output a solidifiable slurry, wherein the furrow comprises (i) a large furrow between edges of adjacent ones of the gravel mattresses, and (ii) small furrows in a top of the gravel mattresses, the small furrows being smaller than the large furrow;

disposing stop components in the small furrows, wherein the stop components fill the small furrows;

after disposing the stop components, simultaneously backfilling the immersed tubes; and then grouting the base of the joint between the immersed tubes using the grouting tube.

20. The method according to claim 19, further comprising, after disposing the grouting tube, implanting the immersed tubes on the gravel mattresses.

* * * * *